US009468239B2

(12) United States Patent
Battah

(10) Patent No.: US 9,468,239 B2
(45) Date of Patent: Oct. 18, 2016

(54) TROUSER FOR MALE USERS THAT LIFTS AND SHAPES THE FORM OF THE BUTTOCKS

(71) Applicant: Juan Antonio Said Battah, Mexico City (MX)

(72) Inventor: Juan Antonio Said Battah, Mexico City (MX)

( * ) Notice: Subject to any disclaimer, the term of this patent is extended or adjusted under 35 U.S.C. 154(b) by 0 days.

(21) Appl. No.: 14/640,402

(22) Filed: Mar. 6, 2015

(65) Prior Publication Data

US 2016/0029708 A1 Feb. 4, 2016

(30) Foreign Application Priority Data

Aug. 1, 2014 (MX) ..... Mx/a/2014/009333

(51) Int. Cl.
*A41D 1/06* (2006.01)

(52) U.S. Cl.
CPC ..... *A41D 1/06* (2013.01); *A41D 2400/38* (2013.01); *A41D 2500/00* (2013.01)

(58) Field of Classification Search
CPC ..... A41D 1/06; A41D 27/00; A41D 27/02; A41D 27/04; A41D 27/06; A41D 27/20; A41D 27/24; A41D 2300/50
USPC ..... 2/227, 247, 275
See application file for complete search history.

(56) References Cited

U.S. PATENT DOCUMENTS

| | | | | |
|---|---|---|---|---|
| 3,234,947 | A | 2/1966 | Bergstein | |
| 3,800,332 | A * | 4/1974 | Forrest | A41D 1/06 2/237 |
| 4,325,379 | A | 4/1982 | Ozbey | |
| 5,535,451 | A | 7/1996 | Tassone et al. | |
| 5,888,118 | A | 3/1999 | Kishi | |
| 6,360,375 | B1 | 3/2002 | Hart | |
| 6,543,062 | B1 | 4/2003 | Amsel et al. | |
| D736,495 | S * | 8/2015 | Bednarz | D2/742 |
| D745,251 | S * | 12/2015 | Bednarz | D2/742 |
| D745,252 | S * | 12/2015 | Bednarz | D2/742 |
| 2010/0136882 | A1* | 6/2010 | Malish | A41C 1/06 450/11 |
| 2014/0165265 | A1* | 6/2014 | Tulin | A41D 1/06 2/234 |

* cited by examiner

*Primary Examiner* — Gloria Hale
(74) *Attorney, Agent, or Firm* — Foley & Lardner LLP

(57) ABSTRACT

Buttock lifting trousers for male users are provided which are made in fabric that is comfortable for male users. The trousers contain spandex fibers to gather the tissue of the thighs and buttocks in order to house them in a cavity made by the cuts featured in the trousers. The insertion of an anterior/posterior oblique panel accomplishes the function of protecting, ventilating and preventing pressure on the genital area. Cuts made in the rear pieces when assembled create a cavity, which is sufficient to accommodate the buttocks and retain them. The trousers prevent seams and cuts from causing harm to the skin. The shape of the back pockets in the central sides have a diagonal line, which when placed in the rear, gives the effect of separation and greater roundness of the buttocks.

5 Claims, 8 Drawing Sheets

TROUSER FOR MALE USERS THAT LIFTS AND SHAPES THE FORM OF THE BUTTOCKS

FIELD OF THE INVENTION

The present invention relates to a male user trouser for uplifting and shaping the buttocks. Said trouser does not cause harm or aggression to the wearer's skin thus offering a comfortable garment.

BACKGROUND OF THE INVENTION

Denim jeans were originally a working garment, but approximately from 1950 they began to impose as a youth garment. The trouser industry has remarkably developed in recent years, trends change rapidly and thus potential consumers of new products in this category emerge. Today chances are wider to use jeans and they have become synonymous with luxury, style, modernity and aesthetics. Thus we find products to mold the figure, with custom washes and in turn having some detail (patches, embroidery, zippers, tearings) to achieve a custom-like trouser.

Trousers that help to the good looks of the user have also been created in the market, such as raising the buttocks.

This end has been carried out in different ways. Some trousers are focused on the use of elastic, others in the use of cuts in construction molds, and other use stretch fabrics.

It is noteworthy that sometimes said products only give the appearance of raising the buttocks, without making it physically and in other cases, even if the garment shapes the body, the result is not always a comfortable garment to the user.

The use of elastic ensures that when worn, the soft tissues fit and conform according to the pressure exerted thereon, as shown in U.S. Pat. No. 6,360,375 which by means of slide belt-shaped intertwined springs which fit around the waist as the main support, adjustable slides that fit a user's thighs which in turn pass through the lower surface of the buttocks to hold and lift the buttocks.

U.S. Pat. No. 4,325,379 refers to a garment that provides for isometrically exercising the muscles of the buttocks and pelvic floor. They are girdle type panties that with the help of elastic shaped as straps give tone to the exterior and interior gluteal muscles and pelvic floor, thus making the buttocks to occupy an unnatural position and are raised by the same straps. This technique is undoubtedly the most used by the inventors, however the disadvantage found by end users is that the springs have a direct effect on the body, leaving marks on the skin, leaving aside the wearing comfort.

In previous paragraphs we emphasize that jeans have been considered as an alternative to shape the body silhouette, for this reason there have also made inventions somehow modifying the above described techniques.

For example, U.S. Pat. No. 3,234,947 describes a garment, particularly a trouser, which includes a strip which presses around the abdomen, improving posture and giving a smooth and wrinkle free aspect to the user's figure.

U.S. Pat. No. 6,543,062 discloses a better approach that the control of the abdomen. They are trousers divided into two, back and front, with a short front waist and longer waist to accentuate the buttocks of the wearer, plus elastic (spandex) reinforcements placed in the left (L) and right (R) front parts to push the abdomen, improve the user's posture while giving the effect of lifting the buttocks. This is accomplished with the help of lines and seams (S) that shape the buttocks visually, wherein stretch fabric is used to achieve lifting the buttocks.

As for getting a better silhouette, U.S. Pat. No. 5,535,451 proposes that by giving lower cavity in the legs, i.e., narrowing the distance from the crotch (Ch) and conventional side seams (S) results in some pressure on the thighs while dragging the skin to accommodate and rise the buttocks, also avoiding separation thereof and thus achieving an enhancement of the profile that the user wants to obtain.

U.S. Pat. No. 5,888,118 provides the complement to define what earlier had not considered, i.e. including a cavity in the rear part of the garment to accommodate the buttocks, they also mention the importance of the direction and composition of fabrics to achieve set, monitor and sustain the abdomen, hips and buttocks.

The inventions described above, each for its part has developed a special design with different characteristics in order to lift the buttocks, however there is no garment on the market that is specifically aimed at a male user. The challenge of making a trouser of these features for male users is relevant for the fact that the anatomy of men and women is different and therefore a garment that meets these characteristics and is comfortable to male users can not be inferred from what already exists.

SUMMARY OF THE INVENTION

The present invention refers to a trouser for male users that lifts the buttocks. The trouser is made of fabrics containing elastane fibers to gather the tissues of the thighs and buttocks to house them in a cavity made by the cuts of the garment. The insertion of an obliquely shaped anterior/posterior panel (P) to protect, ventilate and prevent pressure on the genital area and the cuts made in the rear parts when assembled create enough cavity to accommodate the buttocks and sustain them. Furthermore the shape of the rear pockets (K) in the central sides feature a diagonal line, which when placed in the back part give a separation effect and higher roundness of the buttocks. With all these a trouser is achieved that enhances the buttocks with adjustment of the thighs (A) but with the advantage that the user's genital area is not altered.

Thus, the characteristic details of this novel trouser refer to cuts in the front parts and pleats in the rear parts that when joined exert pressure on the muscle tissues of the legs and buttocks to house them in the cavity created in the rear part. The height piece (H) has a round shape to give the appearance of volume to the complete rear part. This garment has a reinforcing panel (H') which covers the central part of the genitals.

DETAILED DESCRIPTION OF THE INVENTION

Figure 1:
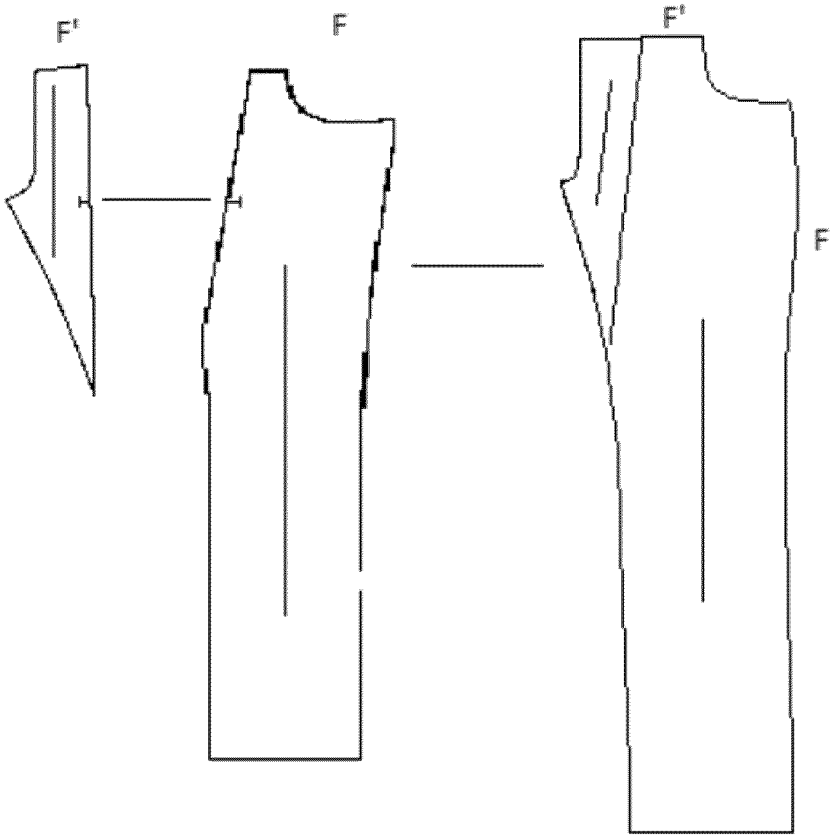
FIG. 1 is a separate view of the left (L) front part. The fabric yarn that will serve to create a reinforcement panel covering the central part of genitals and lower abdomen is observed.
Figure 2:
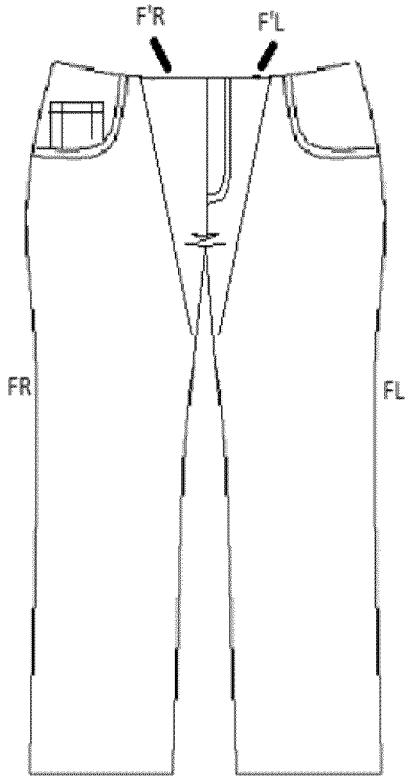
FIG. 2 is a fully assembled view of the front piece (F). The whole reinforcing panel (H') that will cover the genitals and lower abdomen is shown.
Figure 3:
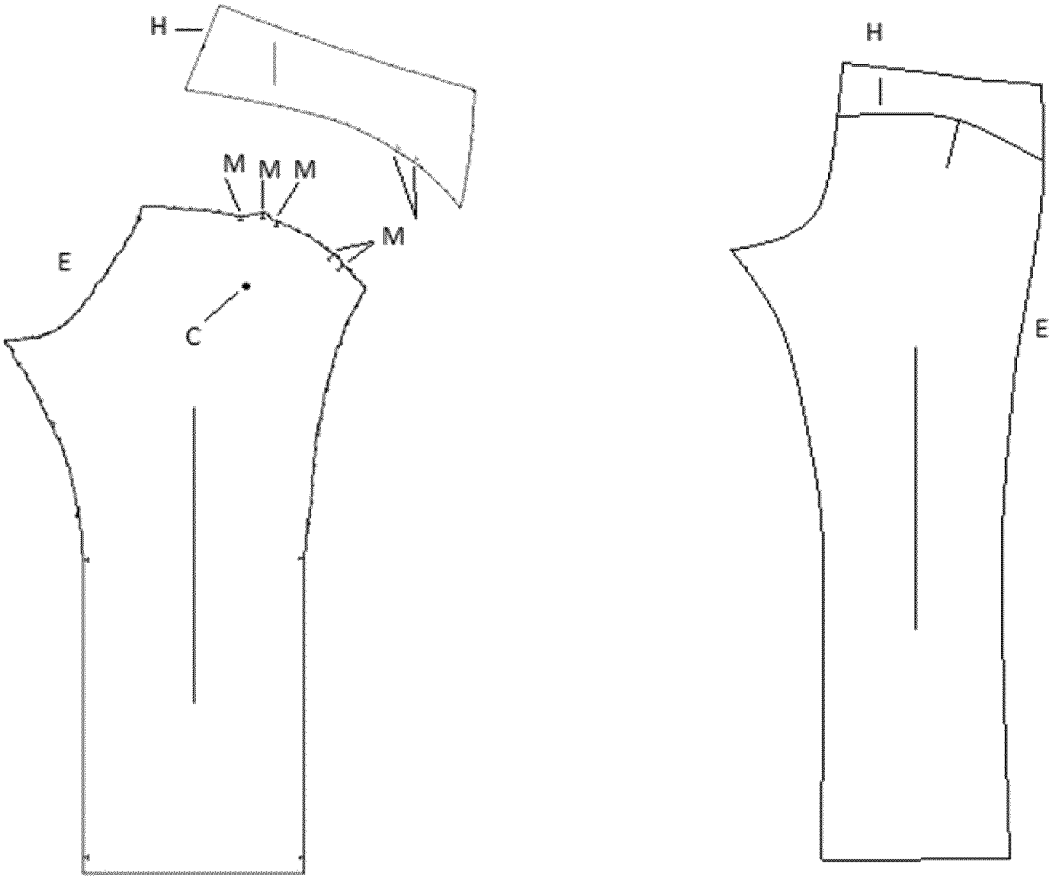
FIG. 3 is a view of the right (R) rear part without joining the height part. It has cuts on top to form pleats that will house the buttock. The curved shape in the upper edge of the rear part and lower edge of the height piece (H) are shown.
Figure 4:
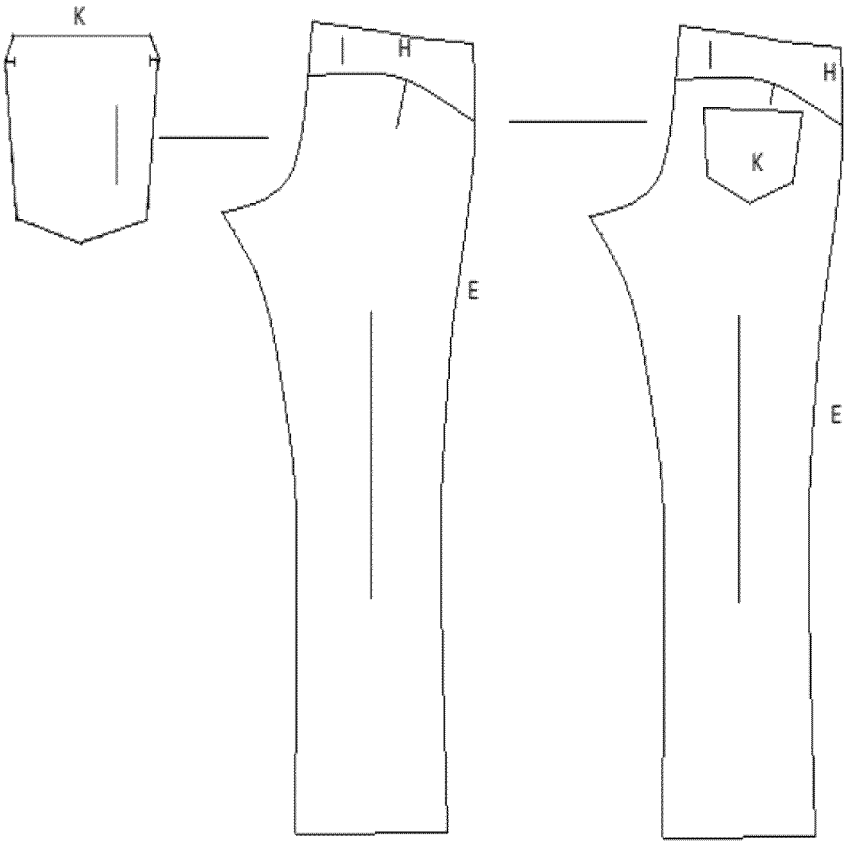
FIG. 4 is a view of the size, position and placement of back pockets (K) and the yarn direction for the parts trace.
Figure 5:
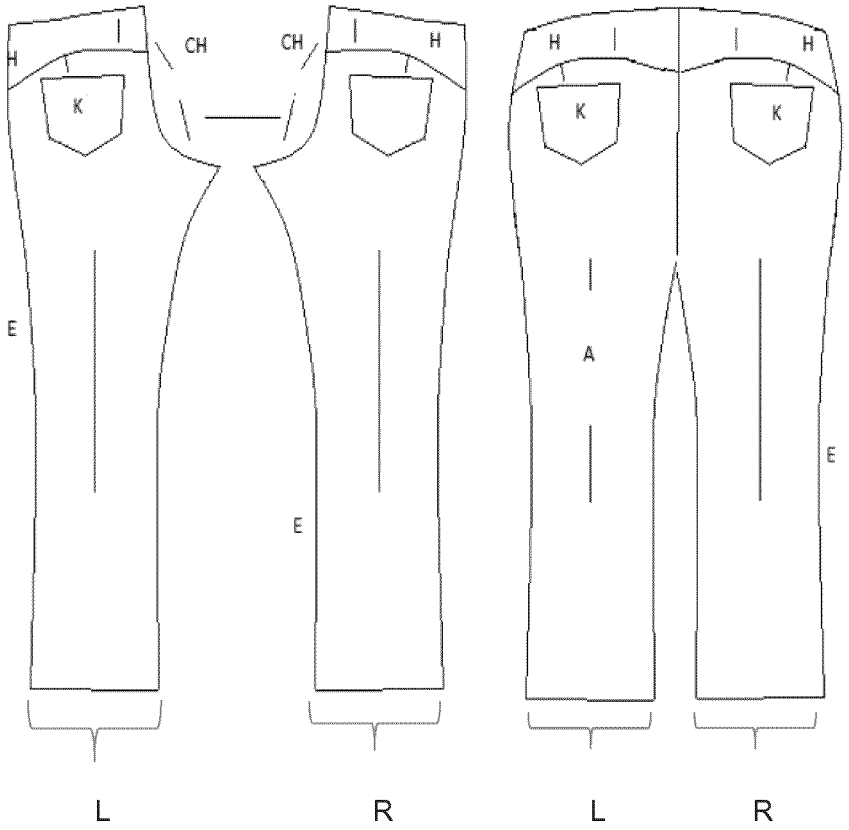
FIG. 5 is a view of the rear parts separately to appreciate the depth of the crotch (Ch) seam and union to the height part.
Figure 6:
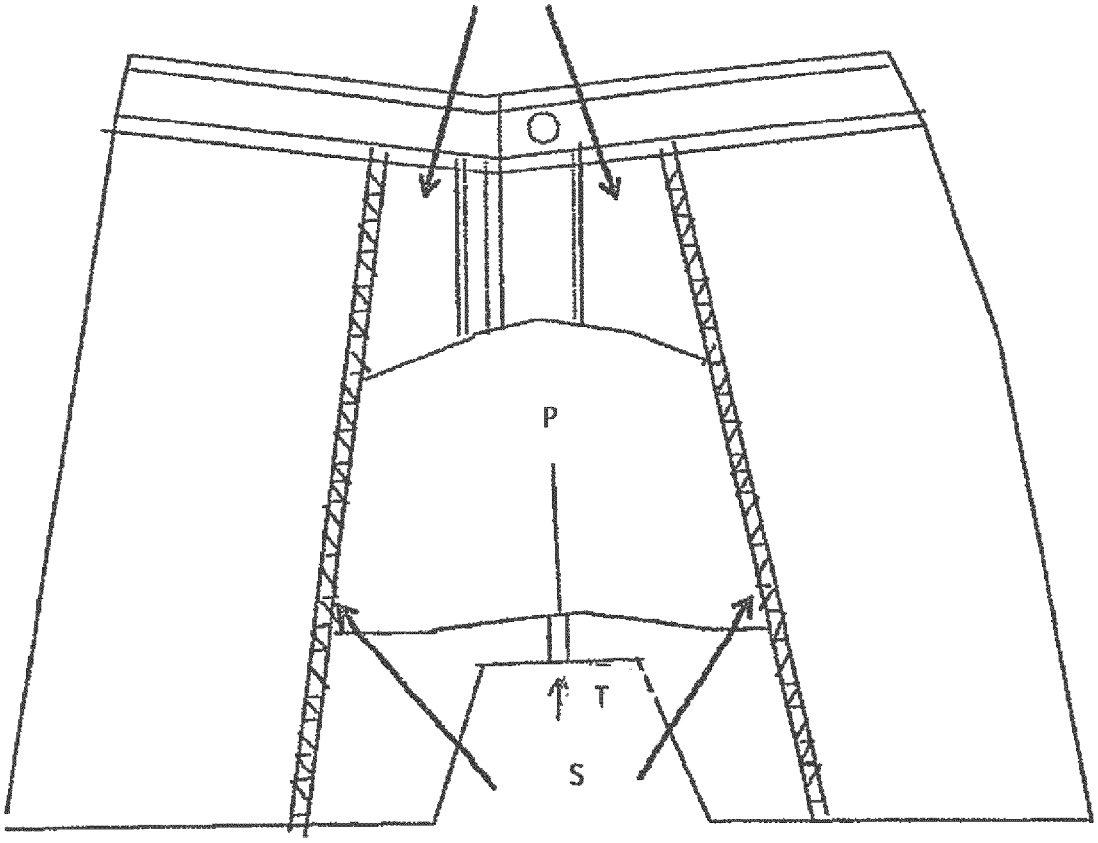
FIG. 6 shows the anterior/posterior panel (P) that this sustained from the inner seams (S) of the first two parts of the center of the reinforcement panel of the front piece (F) and crotch (Ch) seam.
Figure 7:
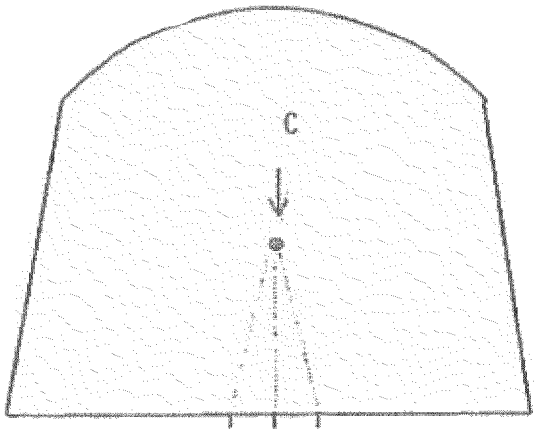
FIG. 7 shows the part of the anterior/posterior panel (P) with plumbs (M) to join and create the pleat that protects the genital area.
Figure 8:
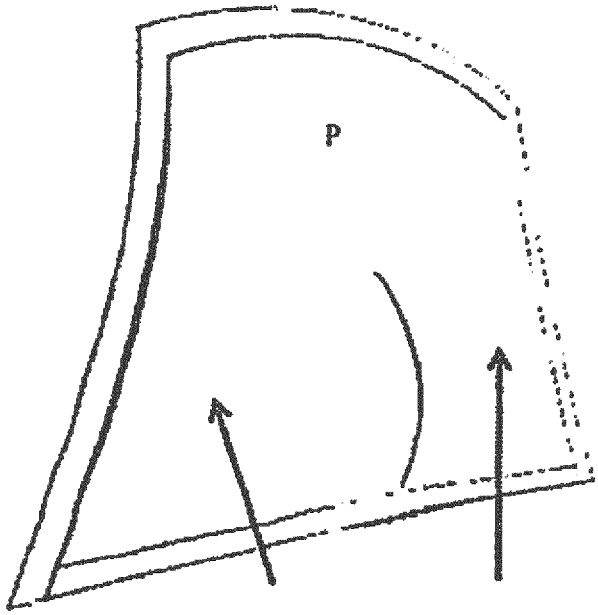
FIG. 8 shows the obliquely-shaped anterior/posterior panel (P) by joining the plumbs (M).

The buttock lifting trouser for male users is designed to lift the buttocks without pressure in the genital area, with the implementation of denim-like flat fabrics with specific characteristics and properties to meet the guidelines of quality, health and promise of innovative product to the wearer, as can be seen in Table 1.

The trouser of the invention is made from elastane fiber fabrics that when drawing parts of the trousers in the fabric along the thread, a cavity is obtained to accommodate the buttocks. Reinforcing panels in which there is free pressure in the front crotch (Ch) seam area are also created. It also consists of an inner fabric panel anterior/posterior to the zipper to prevent discomfort in the genital area.

In the back and top of the rear parts, there is a curved pleat in the middle, this part is attached to the height piece (H) in order to create gluteus control and a space to house it. Visually the curve highlights the shape of the buttock. The rear crotch (Ch) seam is long and deep to separate the buttocks. The rear pockets (K) cover excess fabric that is created when making the pleat in each of the rear parts.

The buttock lifting trouser for male users is divided into 4 parts, which form a reinforcing panel (H') on the front crotch (Ch) (Ch) seam, from the waist to the crotch (Ch) (Ch), designed for the genital area to be free of pressure. This panel controls and reduces the elasticity of the fabric in the genital area.

The buttock lifting trouser has a front part featuring an anterior/posterior fabric panel obliquely to the height of the zipper, sustained from the inner cuts of the referred panel. The bottom part of the panel is sustained from the crotch (Ch) (Ch) of the front crotch (Ch) seam with a polyester tape (T) that creates a distance margin of 1" (one inch) between the fabric panel and the crotch (Ch) seam. The panel must be fixed to provide comfort to the user.

The union of the front parts does not allow elastane of the fabric to exert pressure on the genital area and lower abdomen of the male user.

The eyelet piece is joined to the left (L) front piece (F) to place the zipper. The false is joined to the right (R) front piece (F) in order to cover the zipper inside so as not to press the genitals of the male user.

The anterior/posterior panel (P) creates the cavity that covers and protects the genital area from the elasticity and the properties of the fabric used for making the trouser.

The anterior/posterior panel (P) is marked with three plumbs (M), the plumbs (M) should be joined with a seam to the central plumbs (C) in order to obtain a zero plumb piece which serves to obliquely protect and ventilate the genital area, avoids exposure of the genitals to the pressure exerted by the trouser in the user's thighs. This panel is internal.

The buttock lifting trouser for male users has a mold drawing in the yarn direction of the fabric to make a straight reinforcement panel all around the front crotch (Ch) seam, from the waist to the crotch (Ch) ending in a peak shape.

By dividing the front parts into right (R) and left (L), each of these is divided into two pieces that when vertically joining with seams (S) in an upright (R) position the front piece (F) is seen cut in two parts. Yarn fabric in upright (R) position is respected, the movement of the front parts is controlled avoiding free elasticity and obtaining greater control of the zipper without the mold design pressing the groins and genital area. This is done for both front parts and then they are joined to create the reinforcement panel that once made is seen divided in four by seams (S).

The front pieces (F) at the thigh level are reduced in width of leg from the crotch (Ch) to the side, so that the user's body mass is retained by elastane fiber toward the rear and lifts the buttocks.

The rear part, namely the right (R) and the left (L) parts, form a curve on the top edge which is attached to the height piece.

The pleats of the rear parts are designed to create a space that houses the buttock.

At the top of the rear part three plumbs (M) to the center are marked. The plumbs (M) of the side should be joined by seam to the center plumbs in order to obtain a zero plumbs pleat. This pleat is fixed under the height part. By joining the plumbs (M) they will also serve as a guide for joining the rest of the waistband. Two plumbs (M) are marked at the side of the back piece in the direction of the hip, and two plumbs (M) in the height piece (H) at the same level, respecting the curved shape of the parts in the joining edges. plumbs (M) (1) and (2) to (3) and (4) are joined to form a single piece; with this modification the original thread of the back piece is rotated. The pleat that was created by joining the plumbs (M) and joining the height piece (H) to the back piece gives rise to a cup and the space required to house the gluteus. Visually the curved shape of the upper back part gives volume to the buttocks and the union of the rear parts in the center. The threads of the fabric are bias sideways.

The pockets (K) are right (R) in the middle of the back piece, it is taken as a referenced the pleat created with the plumbs (M) (1a), (2a) and (3a) and is lowered 1" (one inch) toward the center of the buttock. The distance of the pocket (K) sides toward the center of the back piece is 1 cm from the seams (S) of the height piece (H) and to the right (R) side or hip is 3 mm from the height piece. The pocket (K) is just on the curved form obtained when having completed the back piece. The pockets (K) hide the excess fabric that formed when creating the pleat in the center of the rear part and in turn control the cavity which the buttock is housed.

The rear pockets (K) must cover the pleat on the back piece, matching the center of the pockets (K) with the pleat. The pocket (K) should be right (R) without turning and 1" from the seam down, the pocket's (K) position should be respected in relation to the pleat and curve.

The crotch (Ch) seam of the back piece is longer than the front piece (F). The rear crotch (Ch) seam is curved for added depth to the crotch (Ch) seam and separates the buttocks. By joining height piece (H) to the rear part greater control support for the waist is created by the curved shape and controls the natural shape of the buttock from above with the help of the pleat at the center of the rear part and the yarn direction of each piece. The right (R) and left (L) rear pieces (E) come together from the crotch (Ch) seam, then assembled with the front parts, the sides and crotch (Ch) to form the trousers. The leg is slightly reduced in the thighs to apply pressure and collect the body mass into the cavity formed in the rear parts to accommodate the user's buttocks.

FINISHED FABRIC SPECIFICATIONS

| | |
|---|---|
| Weigth | 11.2 |
| Weave | 3/1 RHT |
| Compositon | Cotton 99% Spandex 1% |
| Warp Material | Cotton Cotton |
| Weft Material | Cotton Cotton-Spandex |
| Dye | Sunrise |
| Additional Dye | Sulphur Bottom/16 Dips indigo |
| Finishing Process | Mercerized |
| Overdye | |

-continued

| FINISHED FABRIC SPECIFICATIONS | | | | |
|---|---|---|---|---|
| | Standard ASTM | Test Method AATC | | |
| Constructions | | | Warp | 7.5 + 9.5 |
| (Ne) | | | Weft | 9.5 + 10.1 |
| Yarn/inch | D-3775 | | Warp | 71 |
| | | | Weft | 54 |
| Total Width (inch) | D-3774-96** | | | 66.5 |
| (cm) Average | | | | 169 |
| Cuttable Width(inch) | D-3774-96** | | | 65.7 |
| (cm) Average | | | | 167 |
| Weigth (gr/m$^2$) | D-3776 | | | 381 |
| Weight afterwash (gr/m$^2$) | | | | 400 |
| Tensile Strength | D-5034 | | Warp | 160 |
| (Lbf) Minimum | | | Weft | 110 |
| Tear Strength | D-1424-96 | | Warp | 11 |
| (Lbf) Minimum | | | Weft | 9 |
| Stiffness Tester | D-4032-94 | | | |
| (Lbf) Average | | | | 5 |
| Crocking | | 8 | | 2.2-3 |
| Shrinkage | | 135-136* | Warp | −4% |
| (%) Maximum | | | Weft | −9% |
| Skew | | 179* | | |
| (%) Average | | | | 8% |
| Skewness | D-3882-90* | | Right | 4% |
| (%) Maximum | | | Left | 4% |
| Bow | D-3882-90* | | | |
| (cm) Average | | | | 0.5 |
| Stretch | D-3107* | | | 18% |
| Growth | D-3107* | | | 4% |
| pH Vaue | | 81 | | 6 a 9 |
| Formaldehyde (ppm max) | | 112 | | N/A |
| Yarn sippage (lbs) Points per 100 yd$^2$ | D-434-95 | | | N/A |

The invention claimed is:

1. Trousers for a male user, the trousers being made of elastane fibers fabric, the trousers comprising:

a cavity to accommodate buttocks of the male user;

an anterior/posterior inner fabric panel which does not contain elastane and which has free pressure in a crotch seam area said inner fabric panel creating a cavity that covers and protects the genital area from elasticity; and rear pockets which cover a pleat of a rear piece, a center of at least one of the rear pockets coinciding with the pleat the at least one pocket being a right pocket, formed without a turn and at 1" from a seam down, a position of the at least one pocket being relative to the pleat and a curved portion.

2. The trousers according to claim 1, wherein the cavity to accommodate the buttocks is formed as follows:

three plumbs at a center portion are marked in an upper edge of the rear piece;

plumbs at sides are seamed to a central plumb to obtain a zero plumb pleat;

the pleat is attached underneath a height piece;

when the plumbs are joined they serve as a guide for joining a rest of a waistband;

two plumbs are marked on a side of the rear piece in a direction of a hip, and two plumbs in the height piece are at a same level with respect to a curved shape of pieces in joining edges;

the plumbs are attached to form a single piece and with such modification an original thread of the rear piece is turned, and the pleat, which is created by a union of the plumbs and a union of the height piece to the rear piece gives rise to a cup and space to house the buttocks.

3. The trousers according to claim 1, wherein the anterior/posterior inner fabric panel has an oblique shape at a zipper level, retained from inner cuts of the panel, wherein a bottom part of the panel is retained from a front crotch seam with a polyester tape that creates a distance margin of 1" between the fabric panel and the crotch seam, and wherein the panel is fixed.

4. The trousers according to claim 2, wherein the anterior/posterior panel has a pleat seam at a center thereof.

5. The trousers according to claim 1, wherein a crotch seam of a rear piece is longer than a front piece.

* * * * *